US009241548B2

(12) United States Patent
Bretz

(10) Patent No.: US 9,241,548 B2
(45) Date of Patent: Jan. 26, 2016

(54) COIN AND METHOD FOR PRODUCING A COIN

(71) Applicant: WICKEDER WESTFALENSTAHL GMBH, Wickede (DE)

(72) Inventor: Wolfgang Bretz, Iserlohn (DE)

(73) Assignee: Wickeder Westfalenstahl GmbH, Wickede (DE)

( * ) Notice: Subject to any disclaimer, the term of this patent is extended or adjusted under 35 U.S.C. 154(b) by 0 days.

(21) Appl. No.: 14/371,919

(22) PCT Filed: Jan. 14, 2013

(86) PCT No.: PCT/EP2013/050596

§ 371 (c)(1),
(2) Date: Jul. 11, 2014

(87) PCT Pub. No.: WO2013/107715

PCT Pub. Date: Jul. 25, 2013

(65) Prior Publication Data

US 2014/0345173 A1 Nov. 27, 2014

(30) Foreign Application Priority Data

Jan. 17, 2012 (DE) ..... 10 2012 006 233

(51) Int. Cl.

| | |
|---|---|
| ***G09F 3/02*** | (2006.01) |
| ***A44C 3/00*** | (2006.01) |
| ***A44C 21/00*** | (2006.01) |
| ***B44C 5/00*** | (2006.01) |
| ***G07F 1/06*** | (2006.01) |

(52) U.S. Cl.

CPC ..... *A44C 3/004* (2013.01); *A44C 21/00* (2013.01); *B44C 5/00* (2013.01); *G07F 1/06* (2013.01); *Y10T 29/49* (2015.01); *Y10T 29/49826* (2015.01); *Y10T 83/04* (2015.04)

(58) Field of Classification Search

USPC ..... 40/27.5

See application file for complete search history.

(56) References Cited

U.S. PATENT DOCUMENTS

| | | | | |
|---|---|---|---|---|
| 632,938 | A | 9/1899 | Greenburg | |
| 3,499,739 | A * | 3/1970 | Segel | 428/579 |
| 3,750,253 | A | 8/1973 | Miller | |
| 3,753,669 | A * | 8/1973 | Churchill | 428/671 |
| 4,644,674 | A * | 2/1987 | Burrows et al. | 40/27.5 |
| 5,676,376 | A * | 10/1997 | Valley | 273/288 |

(Continued)

FOREIGN PATENT DOCUMENTS

| | | |
|---|---|---|
| DE | 390318 C | 2/1924 |
| DE | 403578 C | 10/1924 |

(Continued)

*Primary Examiner* — Joanne Silbermann

(74) *Attorney, Agent, or Firm* — Laurence A. Greenberg; Werner H. Stemer; Ralph E. Locher

(57) ABSTRACT

Coins, medals or casino tokens have a first side, a second side, at least one first layer made of a first material and at least one second layer made of a second material, wherein the first layer is between 10 μm and 90 μm, preferably 20 μm thick. A method produces the coin wherein the coin is produced, more particularly punched, from a clad sheet-shaped composite material. A further method produces the coin wherein the coin is formed from a ring and a core arranged inside the ring. The core and the ring are punched from a clad sheet-shaped composite material and subsequently the core is inserted rotated into the ring and is fixed therein.

20 Claims, 7 Drawing Sheets

(56) References Cited

U.S. PATENT DOCUMENTS

| | | | | |
|---|---|---|---|---|
| 5,996,262 | A * | 12/1999 | Kim | 40/27.5 |
| 6,413,653 | B1 * | 7/2002 | Araki et al. | 428/627 |
| 2004/0173434 | A1 | 9/2004 | Morita | |

FOREIGN PATENT DOCUMENTS

| | | | |
|---|---|---|---|
| DE | 102004001464 | A1 | 7/2004 |
| EP | 0484813 | A1 | 5/1992 |
| EP | 0603564 | A2 | 6/1994 |

* cited by examiner

COIN AND METHOD FOR PRODUCING A COIN

BACKGROUND OF THE INVENTION

Field of the Invention

The present invention relates to a coin, medal or a casino token and also to a method for producing a coin, medal or a casino token. For the sake of simplicity, reference is made merely to a "coin" hereinbelow.

Coins—in particular higher-value denominations—are subject to the constant risk of being forged. Attempts are therefore made to provide coins with features which have a high degree of security against forgery. This is done on the one hand by the selection of what are termed coin materials, which are used predominantly for coin production—e.g. CuNi25 or Nordic Gold—and therefore are not freely available or are freely available only with difficulty on the free market; on the other hand, this is done by optical distinctive features such as edge shaping and edge inscriptions, imprinted images and reliefs or else as bicolor versions.

In addition to the aforementioned properties, coin validators use a sensor to check—in addition to weight and dimensions—in particular the electromagnetic properties in a frequency-dependent manner, to date on one side. As a measure of the reliable detectability of the coins in electronic coin validators, reference is made to machine verifiability and machine reliability. The coins can consist of solid material or a multi-layer material. The different layers can be produced by electroplating or cladding.

Electroplated coins usually consist of a soft steel core on which metals or alloys are deposited in a symmetrical manner. A single-ply layer having layer thicknesses of approximately 25 μm is common in this respect. There are also two-ply layers, however. Electroplated products have the disadvantage, however, that, by virtue of the deposition kinetics, the layer thicknesses increase over the diameter from the center toward the edge (bone profile), and additionally the steel core can dominate in terms of the electromagnetic xproperties in the coin validator, i.e. the layer thicknesses are deemed to be too small.

Signal properties which can be utilized better are to be expected above approximately 100 μm, and layer thicknesses>300 μm are preferably desirable with respect to a reliable machine verifiability. As a whole, the machine reliability of electroplated coins is therefore greatly limited and moreover the security against forgery is additionally limited by the worldwide availability of numerous electroplating plants.

By contrast, clad coins afford an improved machine reliability. On the one hand, the layer thickness is constant over the diameter—as a result of this, the measurement window of the test sensors can accordingly be limited. On the other hand, the layer thickness can be adapted in a manner tailored to the requirements with layer thicknesses>10 μm. The layer structure is commonly symmetrical with three plies—as in the case of the cores of the "1" Euro and "2" Euro coins. However, five-ply coins having a symmetrical structure are also known. Moreover, further plies are conceivable—what are termed multiple clad coins. These can be provided with additional layers by means of electroplating processes, it being possible for the structure to be symmetrical and also asymmetrical and to reach in theory from 2 to an infinite number of layers.

As in the case of the € 1 (1 EURO) and € 2 (2 EURO) denominations, these multi-layered products can be produced in the form of bicolor coins; that is to say that the coin is composed of two punched parts, the outer ring of which consists of a perforated disk into which a further punched disk—the core—is inserted. The method for joining the aforementioned coins is already known, for example, from U.S. Pat. No. 632,938A.

The crucial feature—in addition to the multi-layered core material in the case of the € 1 (1 EURO) and € 2 (2 EURO) coins—is the optical security feature: ring and core made of different materials which differ in terms of their color: bicolor. It is prior art to provide soft steel rings and soft steel cores with metallic coatings of differing color by electroplating and in this way to produce correspondingly inexpensive bicolor coins. Examples of these are 50 gopiks from Azerbaijan, 100 francs from Rwanda or 1 cedi from Ghana. For these coins too, however, there is a limited machine reliability. However, the rate of scrap can be reduced to the effect that the inner part of the ring which has been punched out is the basis of a further electroplating process and is later joined to the ring which is similarly coated in a different color. A method of this type is described, for example, in DE 403578 A1.

In terms of logistics, the production of clad bicolor coins according to the prior art is complex and associated with high costs, since the ring and core are produced from two different primary materials. Moreover, the punching scrap of the ring material also arises in addition to the punching scrap of the core material. In addition, the punching scrap from the perforation of the ring material is furthermore present. In total, rates of scrap of more than 100% can therefore arise. Although the inner ring material which has been punched out is used in various countries for lower-value denominations, this is not recommended in view of security against forgery, since the forgery of a further denomination can be automatically associated therewith. It is desirable firstly to reduce the rates of scrap from bicolor coin production. To this end, what are termed flip-flop coins have already been proposed. This coin was distinguished by the fact that the first side and the second side consist of clad strips of differing metals/alloys which differ in terms of their color. For this reason, in the case of these flip-flop coins it is also possible to speak of bicolor flip-flop coins. In principle, it would also be possible for the differing coloration to be produced by electroplating on one side or by another form of application of components. Associated diffusion treatments then make it possible for alloys to be formed, these making it possible to achieve appropriate color designs. The deposition of zinc on copper and the subsequent formation of brass would be conceivable here.

The further production of the flip-flop coin then consists in inserting the punched-out core material of the clad composite back into the ring in an inverted form and joining it therein. This forms a coin which in terms of color has on one side on the ring the color of the core from the opposite side—and vice versa. This represents an optical security feature. The edge in this respect can also reveal the colors of the different alloys. This edge feature is used as a security feature for 3-layered cladding systems and has already been described, for example, in DE 390318 A.

The operation for joining the flip-flop coins can be achieved mechanically by speeds of "normal" bicolor production. A further feature is the different coloration of the front and rear sides in terms of the ring and the core as an optical security feature. In addition, the edge reflects the colored aspects of the individual cladding components.

It can be established up to this point that coins, disregarding the edge of the coin, have two sides or surfaces. The two sides or each side can be formed respectively from different materials, it being possible in principle for any desired number of layers or else no further layers to be present between the aforementioned surfaces.

In the case of the conventional two-layered or else multi-layered coins, the first side can be formed entirely from a first material and the second side can be formed entirely from a second material, the first material correspondingly differing from the second material.

Coins which are composed of a ring and a core are referred to as bicolor coins. The ring is generally solid material, and the core—as in the case of the € 1 (1 EURO) and € 2 (2 EURO) coins—can be clad. The term bicolor thus refers to the color differences in terms of viewing one and the same side. In this respect, although there are different material combinations on each side in the case of conventional bicolor coins, the material combination is the same on both sides. Bicolor coins too can have a single-layer or multi-layered structure.

In the case of the bicolor flip-flop coins, the sides of the coin are each formed in certain portions by the core and the ring. In this respect, owing to the turned core or ring, one side of the coin is formed by the outer layer of the core made of a first material and the outer layer of the ring made of a second material and the other side of the coin is formed by the outer layer of the core made of the second material and the outer layer of the ring made of the first material. In this respect, there are different material combinations on each side in the case of bicolor flip-flop coins. Since there is a different coloration on each side and the core or the ring is turned, this type of coin can also be referred to as a bicolor flip-flop coin. Bicolor flip-flop coins too can have a multi-layered structure.

Difficulties can arise when testing the coin in electronic coin validators particularly when different materials face toward each side of the coin, for example in the case of two-layered or multi-layered coins, or the sides themselves are formed from respectively different material combinations, for example in the case of bicolor flip-flop coins.

Commercially available coin validators test the electromagnetic properties of one side of the coin with a defined distance between the coin surface and the sensor surface, and therefore a one-sided coin test is thus defined or it is possible to speak of a one-sided coin test. On account of the different electromagnetic properties of the clad coin alloys—in particular when comparing silver-colored or gold-colored metals or alloys—there is a 50% probability that the coin will be inserted with the "correct" side, i.e. passes the sensor with that side to the features of which the sensor is set. Coins which pass the sensor with the opposite side are rejected, even though they may be genuine. Although DE 10 2004 001 464 A1 has disclosed a sensor which, by means of a reflex sensor, is said to be able to detect different materials of the front and rear sides, this method has not become prevalent, since all existing coin validators would have to be withdrawn from circulation and replaced with coin validators having an altered technology.

In summary, it can accordingly be established that known coins whose sides consist of different materials, in particular multi-layered coins, and/or material combinations on each side, in particular bicolor flip-flop coins, do have a high degree of security against forgery on one side, but cannot be reliably detected by coin validators which carry out a one-sided test.

BRIEF SUMMARY OF THE INVENTION

The object of the present invention was therefore that of proposing a coin which is improved in terms of its testability by an electronic coin validator, in particular that of proposing a coin having different materials or material combinations on each side which can be reliably detected in a coin validator acting on one side irrespective of the side which is guided past the coin validator.

According to the invention, this object is achieved by a coin having the characterizing features of the main device claim. Since the first layer has a thickness of between 10 μm and 90 μm, preferably 20 μm, it is the case that, although the second layer can be optically covered at least in certain portions, the first layer is thin enough that the detection of the second layer by an electronic coin validator is not excessively impeded. In this respect, the different materials on the two sides of the coin can provide an at least two-colored coin which, however, can be reliably detected by an electronic coin validator set up in particular for the detection of the material of the second layer. In this respect, the coin according to the invention can be guided past an electronic coin validator acting on one side with any desired side.

Further advantageous configurations of the proposed coin become apparent in particular from the dependent claims. The features of the dependent claims can in principle be combined with one another as desired.

In an advantageous configuration of the coin according to the invention, it can be provided that the coin has two layers, wherein the first layer forms at least certain portions of the first side of the coin and the second layer forms at least certain portions of the second side of the coin, or the first layer faces toward the first side of the coin and the second layer faces toward the second side of the coin. This configuration of the coin makes it possible to produce in particular two-layered coins having different materials and therefore different colorations of the sides in a very simple manner. In this case, that side of the first layer which does not face toward the second layer entirely forms the first side of the coin and that side of the second layer which is remote from the first layer entirely forms the second side of the coin. The first layer virtually covers the second layer facing toward it. As an alternative, a coin comprising a ring and a core can also be provided with such a configuration. The core and/or the ring in this case likewise has a two-layered structure and the core is inserted turned in the ring. In this way, it is possible to produce a two-layered bicolor flip-flop coin. As a whole, the two-layered variant can be produced very inexpensively.

In this context, it can advantageously be provided that the second layer has a thickness of 0.8 mm to 2.8 mm, preferably 1.8 mm. In this embodiment of the coin, the second layer virtually forms the main body of the coin, from which the actual mechanical stability of the coin arises.

In a further advantageous configuration of the coin according to the invention, it can be provided that the coin comprises a further second layer made of the second material and a main body, wherein the first second layer and the first layer are arranged on one side of the main body and the other second layer is arranged on the opposite side of the main body, wherein the first layer forms at least certain portions of the first side of the coin and the further second layer forms at least certain portions of the second side of the coin, or the first layer faces toward the first side of the coin and the further second layer faces toward the second side of the coin. A coin according to the invention of this type accordingly has an at least four-layered structure. The main body itself can have a single-layered or multi-layered structure and preferably represents the ultimately stable part of the coin. In this respect, it is also the case, for example, that the second layers can have a significantly thinner form than in the two-layered variant.

In this context, it can be provided, for example, that the second layer and the further second layer have a thickness of between 50 μm and 600 μm, preferably 300 μm to 400 μm. Correspondingly, here it is possible to do without possibly costly material of the second layers.

In a further advantageous configuration of the coin according to the invention, it can be provided that the coin is formed from a ring and a core arranged inside the ring, wherein the core and/or the ring has the first layer, the second layer and in particular the further second layer and the main body. In this embodiment, the coin is in the form of a bicolor coin or bicolor flip-flop coin with a preferably two-layered or four-layered core and/or ring. The first and second layers can correspondingly be provided in the core and the ring and also merely in the core or the ring. It is also the case that the core and/or the ring can have a two-layered or multi-layered structure. It is thus possible, for example, for the core and/or the ring to contain merely the two-layered structure already mentioned above. It is also the case that the core and/or the ring can contain the four-layered or multi-layered structure likewise already mentioned above, in particular with the first layer, second layer, main body and second second layer.

In this context, it can advantageously be provided that the first layer of the core is arranged on the side opposite to the first layer of the ring. This essentially constitutes a bicolor flip-flop coin with a turned core or ring. A coin according to the invention of this type which is equipped with many optical distinguishing features can be produced comparatively easily and with particularly little scrap, since both the core and the ring can be punched from one and the same primary material. Then, for example, the core is merely turned and inserted into the ring. This gives rise to a coin having, for example, the first layer on the ring and the second layer on the core as outer visible layers on one side of the coin and having the second layer on the ring and the first layer on the core as outer layers on the other side of the coin. The reliable detectability by a one-sided coin validator is furthermore ensured in spite of the many optical distinguishing features.

In a further advantageous configuration of the coin according to the invention, it can be provided that the coin has a layer made of a third material which is arranged on the side opposite to the first layer. In principle, the same demands should be placed on the third material as on the material of the first layer, but the first material and the third material should differ so as to make it possible to ensure different colorations. In other words, the third material should be selected from the group defined for the first material, but should not be the same as the material which is used as the first material in the coin. It is also the case that the third layer should have the same thickness or lie in the same thickness range as the first layer. In this way, the second layer of the other coin side can likewise be provided—if desired—with a selected coloration, which generally differs from the color of the otherwise exposed second layer. Similarly, this layer can also be penetrated by the sensor calibrated for the second layer, and the second layer lying thereunder can be detected.

Suitable materials for the first layer are preferably copper or copper alloys, for example CuNi8, CuNi10, CuZn6723 or CuZn20Ni5.

Suitable materials for the second layer or the further second layer are likewise copper or copper alloys, for example CuNi25 or CuZn20Ni5. It is essentially provided, however, that respectively different materials are used in a coin for the first layer and the second layer or the further second layer, an identical material being used for the second layer and the further second layer, however.

A material selection can also be made preferably on the basis of the electrical conductivity of the materials. In this context, it can advantageously be provided that the first material and/or the second material have an electrical conductivity of 4 to 106% IACS, preferably 4 to 30% IACS.

It is a further object of the present invention to propose a method for producing a coin according to the invention.

This object is achieved according to the invention by a method according to the independent method claims.

Since the coin is produced from a clad sheet-like composite material, the required thicknesses of the layers can be achieved very easily and above all the layers can be formed with a very constant thickness over the surface of the coin, as a result of which it is possible to achieve very reliable detection of the second layer. Moreover, the individual layers can be detected individually and reliably using coin validators of the latest generation.

A two-part coin according to the invention can likewise be produced in a very advantageous manner by virtue of the fact that the core and the ring are punched from a clad sheet-like composite material, comprising at least the first layer and the second layer or the first layer, two second layers and the main body, and subsequently the core is inserted turned into the ring and fastened therein. In addition to the homogeneous layers over the surface, this method also generates particularly little scrap, since both the ring and the core are produced from the same composite material. In the case of a bicolor flip-flop coin, the scrap rates can be reduced by approximately 100% compared to known bicolor coins.

Further features and advantages of the present invention will become clear on the basis of the following description of preferred exemplary embodiments with reference to the accompanying figures, in which:

DESCRIPTION OF THE INVENTION

Figure 1:
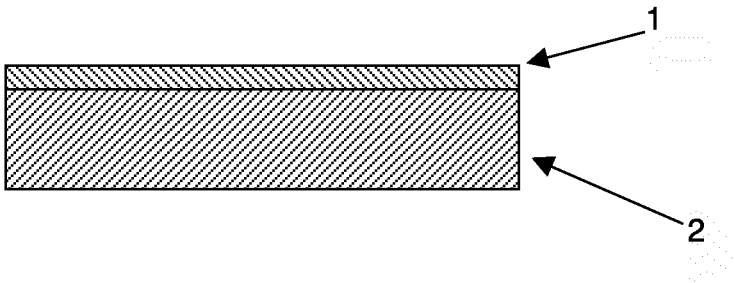
FIG. 1 shows a coin according to the invention in a sectional view (two-layered)
Figure 2:
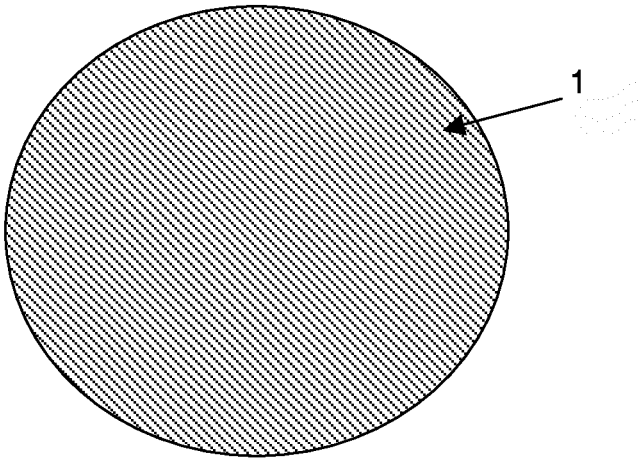
FIG. 2 shows a coin according to the invention in a view onto the first side.
Figure 3:
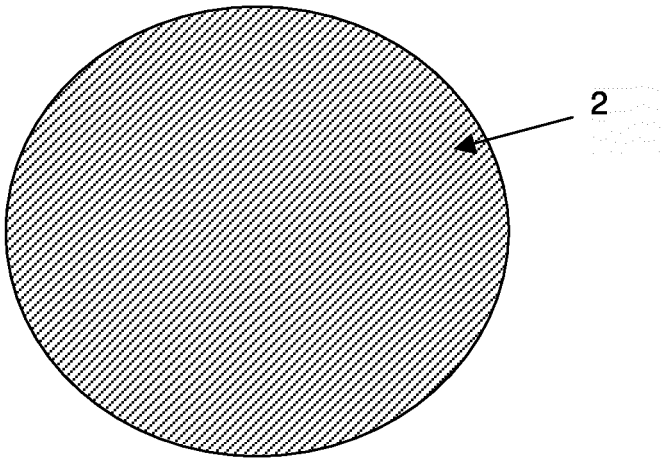
FIG. 3 shows a coin according to the invention in a view onto the second side.
Figure 4:
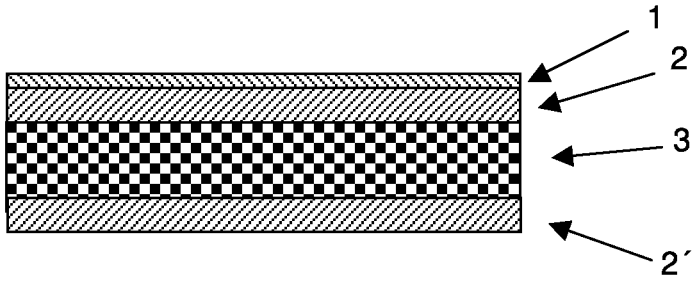
FIG. 4 shows a second embodiment of a coin according to the invention in a sectional view as a four-layered version.
Figure 5:
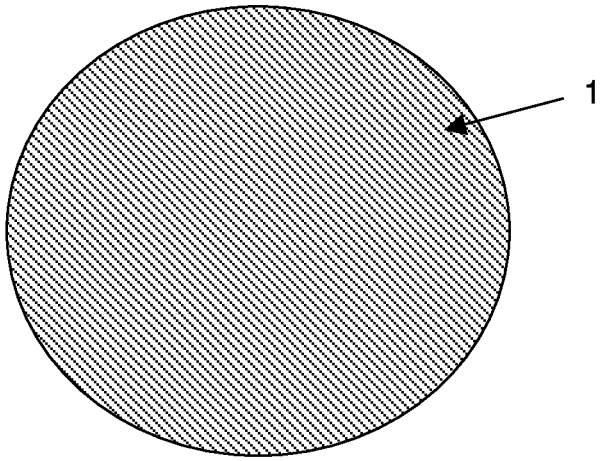
FIG. 5 shows a second embodiment of a coin according to the invention in a view onto the first side.
Figure 6:
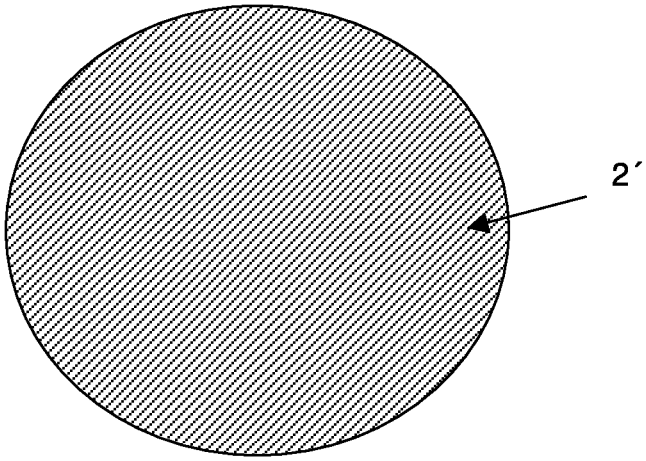
FIG. 6 shows a second embodiment of a coin according to the invention in a view onto the second side.
Figure 7:
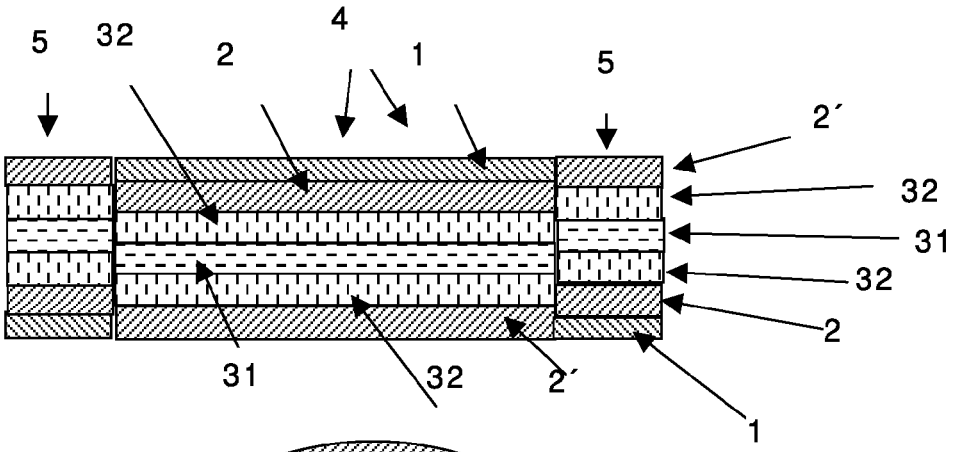
FIG. 7 shows a third embodiment of a coin according to the invention in a sectional view as a bicolor flip-flop coin.
Figure 8:
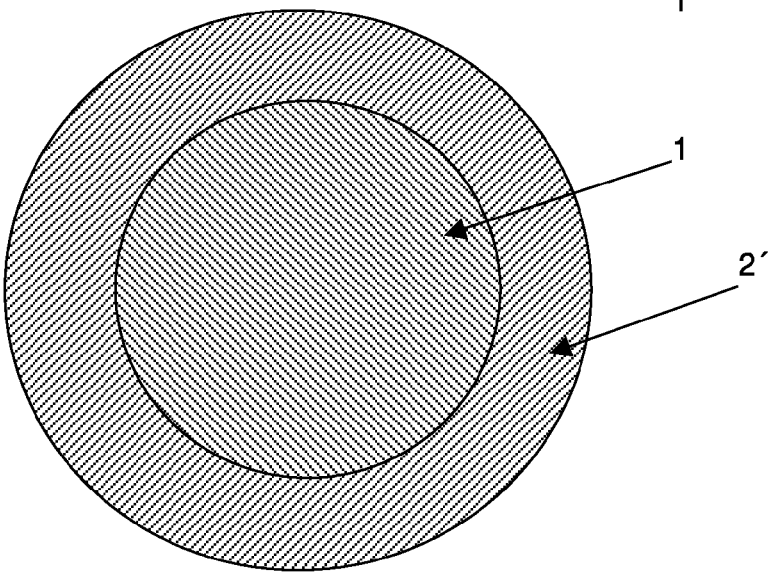
FIG. 8 shows a third embodiment of a coin according to the invention in a view onto the first side.
Figure 9:
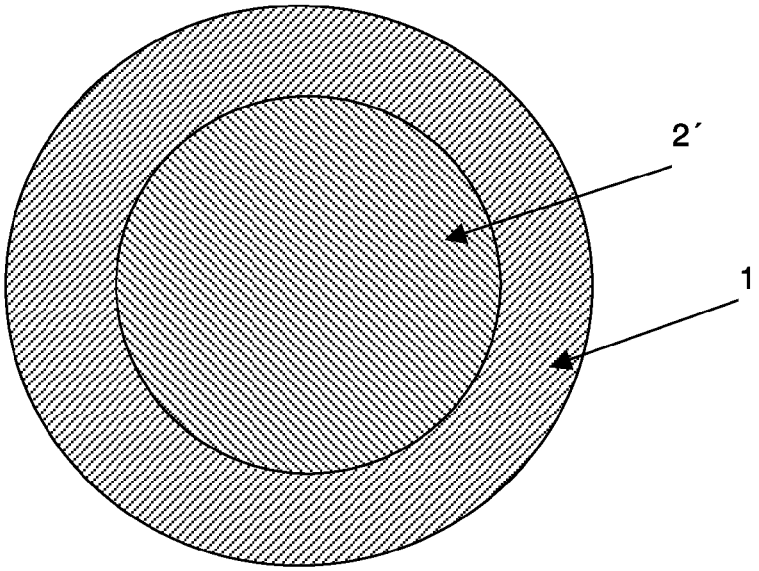
FIG. 9 shows a third embodiment of a coin according to the invention in a view onto the second side.
Figure 10:
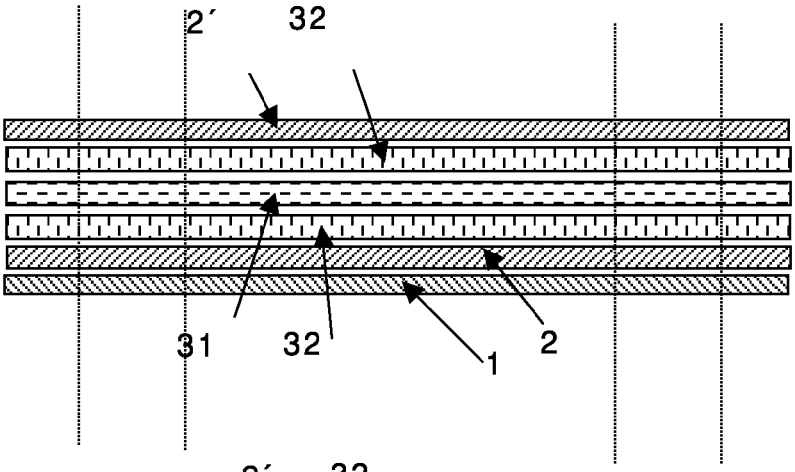
FIG. 10 shows a clad sheet-like composite material for a coin according to the invention, in particular a bicolor flip-flop coin, as shown in FIGS. 7 to 9, with punching indicated.
Figure 11:
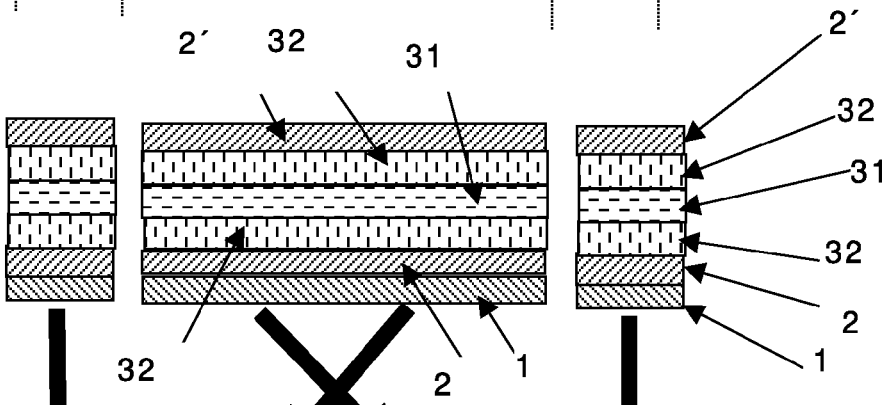
FIG. 11 shows a schematic illustration of the production process for a coin according to the invention as shown in FIGS. 7 to 9.
Figure 12:
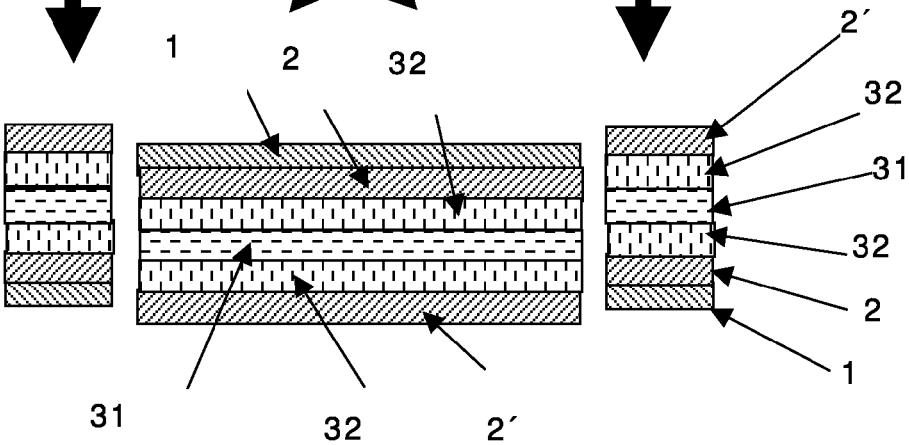
FIG. 12 shows a schematic illustration of the production process for a coin according to the invention as shown in FIGS. 7 to 9.

The size ratios in the figures are not true to scale. The following reference signs are used in the figures:

1 first layer
2 second layer
2' (second) second layer
3 main body
4 core
5 ring
6 layer
31 first main body layer
32 second main body layer A coin according to the invention has at least a first layer 1 made of a first material and a second layer 2 and possibly a further second layer 2' made of a second material. The first, very thin layer 1 forms at least certain portions of the first side of the coin, while the second layer 2 is arranged directly beneath the first layer. The second layer 2 or the further second layer 2' made of an identical material forms certain portions of the other side of the coin. The other side of the coin can also be formed in certain portions by a layer 6, further details of which are provided further below.

This arrangement makes it possible to achieve essentially two aims. Firstly, the polychromatism of the coin is ensured by the different materials of the layers. Secondly, the first layer 1 is thin enough and/or selected in terms of material such that it does not cover the underlying second layer 2 or covers it only to such an extent for the detection by the electronic coin validator that the deviations arising through the first layer 1 can be filtered out or lie in an acceptable tolerance range. An electronic coin validator set up for the detection of the material of the second layer 2 will correspondingly detect the second layer 2 or the material of the second layer 2 beneath the first layer 1 in a sufficiently reliable manner. The second layer or further second layer facing toward the other side will be detected anyway by an electronic coin validator calibrated for the material of the second layer or of the further second layer. The coin can correspondingly be detected from both sides by an electronic coin validator.

Different materials are suitable as the materials for the layers. By way of example, copper materials have proved to be fundamentally suitable for the coin according to the invention. In addition to (technically) pure copper, alloys such as CuNi8, CuNi10, CuZn6723 or CuZn20Ni5 and also all common coin materials are also suitable as the material for the first layer 1. In addition to (technically) pure copper, alloys such as CuNi25 or CuZn20Ni5 and also all common coin materials are also suitable as the material for the second layer.

The selection of the materials for the layers can also be made on the basis of their electrical conductivity. Here, values of 4 to 106% IACS, preferably 4 to 30% IACS, have proved to be particularly advantageous for the layers. In this respect, the first layer 1 preferably has an electrical conductivity of 4 to 106% IACS, preferably 4 to 30% IACS, and the second layer 2 or the further second layer 2' has an electrical conductivity of 4 to 106% IACS, preferably 4 to 30% IACS. IACS is the abbreviation for International Annealed Copper Standard. Here, the conductivity is expressed as a percentage of the conductivity of pure annealed copper. 100% IACS correspond in SI units to approximately 58 MS/m. Alloys or other metals by contrast have IACS values which differ compared to copper, the IACS values differing from alloy to alloy or metal.

The preferred embodiments of the coin according to the invention which are described hereinbelow all have, purely by way of example, a first layer 1 made of for example CuNi10 and at least one second layer 2, possibly also a (second) second layer 2', made of for example CuNi25. The second layers 2 and 2' are each produced from the same material, in this case from CuNi25. The first layer 1 has a thickness in the range of between 10 μm and 90 μm, preferably 10 μm to 60 μm, further preferably 20 μm. It is to be noted that the thicknesses indicated above and below are likewise intended to include the marginal values, i.e. for example the first layer can also have a thickness of exactly 10 μm or 90 μm. The second layers 2, 2' can be present in different thicknesses, but are always produced from the same material. Hereinbelow, the terms first side and second side are used to distinguish the two sides of the coin—it would also be possible to speak of a front side and rear side. The layers, provided that these are outer layers, of course form only certain portions of one side, since one side of an outer layer always faces toward an inner layer or another layer. The list of embodiments is furthermore not conclusive. Further materials, material combinations and configurations are conceivable.

A coin according to the invention in a first embodiment comprises exclusively the first layer 1 and the second layer 2. The first layer 1 faces toward the first side and the second layer 2 faces toward the second side. The second layer 2 has a thickness of 0.8 mm to 2.8 mm, preferably 1.8 mm. The sides 1 or the second layer as the second side can be gold-colored, silver-colored, bronze-colored or reddish, depending on the material. What is crucial is the appearance of the front and rear sides in differing color. With the first layer 1, the first side of the coin is bronze-colored, and with the second layer 2, the second side of the coin is silver-colored.

A coin according to the invention in a second embodiment comprises the first layer 1 and twice the second layer 2, 2' and also a main body 3. Proceeding from the first side to the second side of the coin, the layer sequence is as follows: first layer 1, second layer 2, main body 3, (second) second layer 2'. This gives rise to a coin with a gold, silver, bronze or reddish coloration of the front and rear side, the front and rear side differing from one another in terms of the color. The second layers 2, 2' have a thickness of 50 μm to 600 μm, preferably 300 μm to 400 μm. The main body 3 preferably consists of one ply or layer and has a thickness of 40 μm to 650 μm, preferably 100 μm. As an alternative, the main body 3 can also consist of a plurality of layers.

A coin according to the invention in a third embodiment, in particular as a bicolor flip-flop coin, comprises an outer ring 5 and a core 4. The core 4 is inserted in the ring 5, in particular is pressed or fastened in another way to the ring 5. The core 4 comprises the first layer 1, two second layers 2, 2' and the main body 3. The core 4 can accordingly be designed like the coin in the above paragraph, that is to say the second layers 2, 2' have a thickness of 50 μm to 600 μm, preferably 300 μm to 400 μm. The main body 3 preferably consists of one layer or a solid material and has a thickness of 40 μm to 650 μm, preferably 100 μm. However, the main body 3 of the core 4 can likewise have a multi-layered structure. The ring 5 comprises the first layer, two second layers 2, 2' and the main body 3. The second layers 2, 2' have a thickness of 50 to 600 μm, preferably 300 to 400 μm. The main body 3 of the ring 5 can have a single-layered or multi-layered structure. The ring 5 or the core 4 can also have a quite conventional structure or be configured in solid form, in particular also can be coated by electroplating. The core 4 is inserted inverted into the ring 5, that is to say the first layer 1 of the ring 5 and the second layer 2 of the core 4 form certain portions of the first side of the coin or face toward the first side, and the (second) second layer 2' of the ring 5 and the first layer 1 of the core 4 form certain portions of the second side of the coin or face toward the second side.

The coins according to the invention are preferably produced by cladding, in particular roll cladding. Other methods, for example electroplating etc., are also conceivable, however.

To produce a coin according to the invention as per the first embodiment, the first layer 1, for example made of CuNi10, is clad onto a metal sheet, for example made of CuNi25. The metal sheet in this case represents the second layer 2. In a next method step, the coins according to the invention are punched from the clad sheet-like composite material thus produced.

To produce a coin according to the invention as per the second embodiment, two second layers 2, 2', for example made of CuNi25, are clad onto both sides of a single-layered or multi-layered main body 3. Subsequently, or else at the same time, the first layer 1, for example made of CuNi10, is clad onto one of the second layers 2. In a next method step, the coins are punched from the clad sheet-like composite material thus produced.

It is also conceivable firstly to clad the first layer onto one of the second layers. Then, by way of example, a second second layer can be clad onto the main body and then the combination of the already clad first and second layer can be clad onto the main body.

To produce a coin according to the invention as per the third embodiment, two second layers 2, 2', for example made of CuNi25, are clad onto both sides of a single-layered or multi-layered main body 3. Subsequently, or else at the same time, the first layer, for example made of CuNi10, is clad onto one of the second layers. In a next method step, both cores 4 and rings 5 are punched from the clad composite material thus produced. The cores 4 are turned and are correspondingly inserted into the rings 5 and fastened suitably, for example by pressing, in inverted form.

In all production methods or embodiments, this gives rise to the coins which have at least two differently colored top and bottom sides or even have different colorations on the first side or the second side (third embodiment). A feature common to all coins according to the invention, however, is that they have a high degree of security against forgery as a result of the different colorations. Moreover, coins of this type can also be reliably detected using commercially available coin validators, that is coin validators which carry out a one-sided test. Essentially, this effect is based on the fact that the sensor is tuned to the second layer 2 or 2', that is to say if the coin is fed directly to the sensor with the second layer 2 or 2', reliable detection of the coin takes place in any case. However, with the coin according to the invention, it is also possible for the other side to be reliably surveyed. This can essentially be attributed to the fact that the first layer 1, for example made of CuNi10, influences the electromagnetic measurement of the underlying second layer 2, for example made of CuNi25, only to an insignificant extent, or at least influences it to an insignificant extent for the purpose intended here, such that the authenticity of the coin according to the invention can also be reliably tested from the side with the first layer 1. As a result, it is correspondingly immaterial how the coin is inserted into the coin validator.

Figure 13:
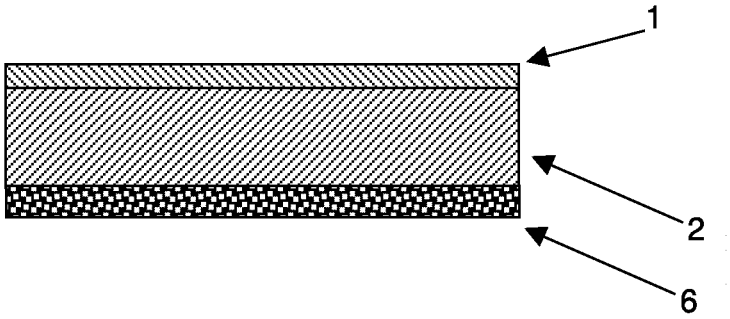
FIG. 13 shows a further embodiment of a coin according to the invention, in particular a two-layered coin having an additional third layer, in a sectional view.
Figure 14:
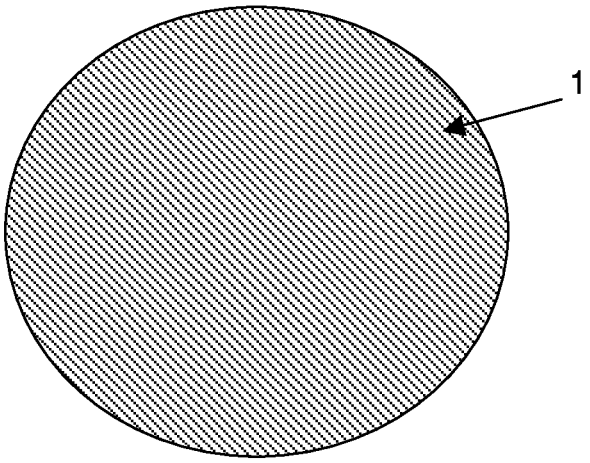
FIG. 14 shows a further embodiment of a coin according to the invention in a view onto the first side.
Figure 15:
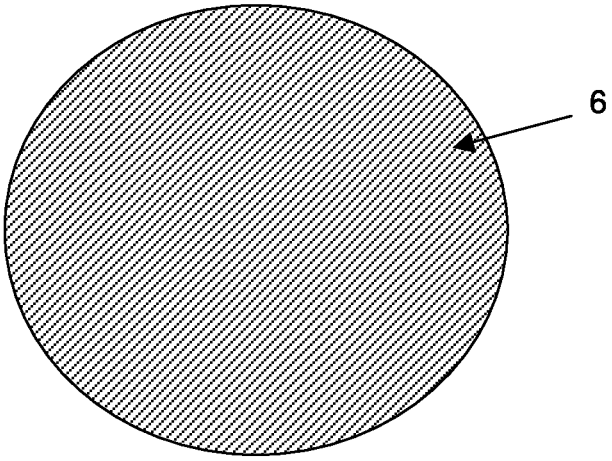
FIG. 15 shows a further embodiment of a coin according to the invention in a view onto the second side.
Figure 16:
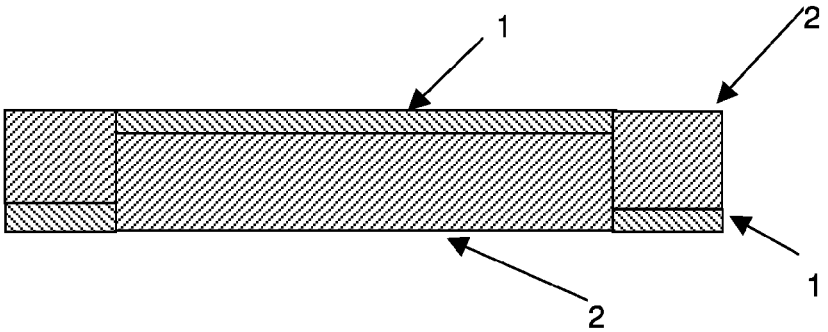
FIG. 16 shows a further embodiment of a coin according to the invention, in particular with a two-layered ring and a turned core.
Figure 17:
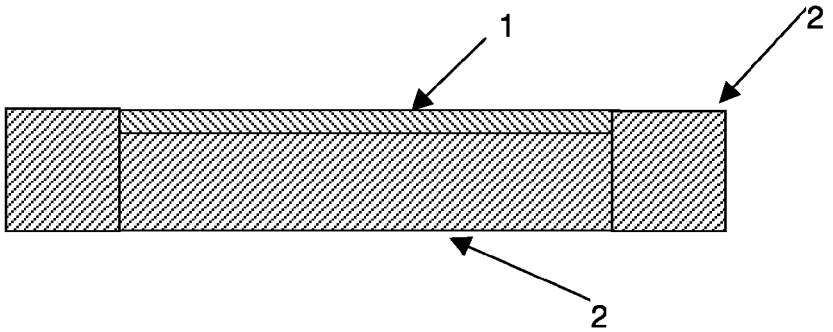
FIG. 17 shows a further embodiment of a coin according to the invention, in particular with a two-layered core and a ring made of solid material.
Figure 18:
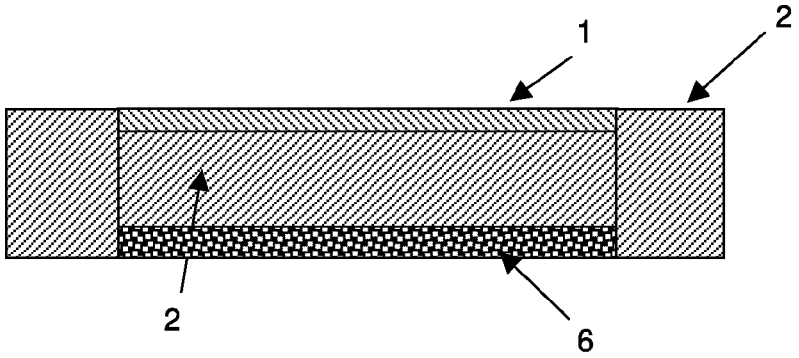
FIG. 18 shows a further embodiment of a coin according to the invention, in particular with a multi-layered core and a ring made of solid material.
Figure 19:
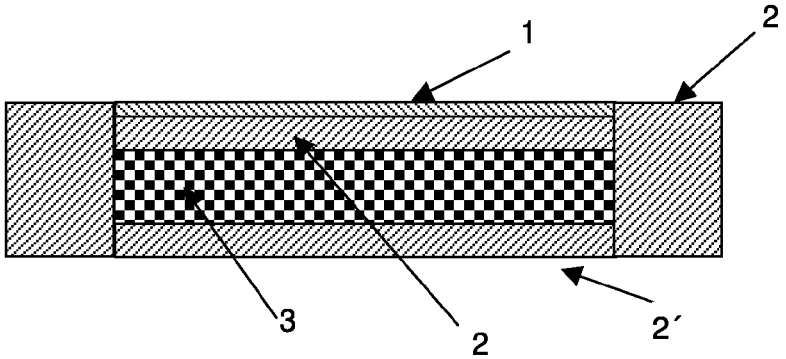
FIG. 19 shows a further embodiment of a coin according to the invention, in particular with a multi-layered core and a ring made of solid material.

In a further embodiment of the present invention, a further layer 6 made of a third material can be used. Thus, for example, a second layer 2 or the further second layer 2' can be coated with a layer 6. However, in order to make it possible to ensure a different coloration of the two sides of the coin, said layer should not consist of the same material as the first layer. In order, for example, to make it possible to ensure the same detectability of the underlying second layer, the layer 6, like the first layer, should likewise have a thickness of between 10 μm and 90 μm, preferably 20 μm, and the third material of the layer 6 should likewise be a material selected from the group intended for the first material, that is for example copper or a copper alloy, in particular CuNi8, CuNi10, CuZn6723 or CuZn20Ni5. It is preferable that the layer 6 should also have an electrical conductivity of 4 to 106% IACS, preferably 4 to 30% IACS. This gives rise to a coin as is shown, for example, in FIGS. 13 to 15. In this case, the first layer 1 forms one side of the coin and the layer 6 forms the other side of the coin. The materials of the aforementioned layers are different so as to give two different colorations. Nevertheless, the underlying second layer 2 can be detected from both sides. The principle can be transferred both to the main body versions and to the flip-flop coin.

Figure 20:
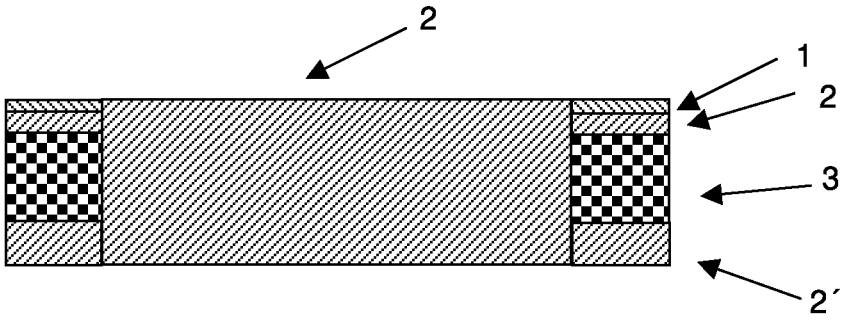
FIG. 20 shows a further embodiment of a coin according to the invention, in particular with a core made of solid material and a multi-layered ring.

FIGS. 16 to 19 show further embodiments of the coin according to the invention. The illustration of further embodiments which is provided here is not conclusive. Further configurations are conceivable. It is also the case, for example, that the material of the second layer 2 has been selected as the ring material. Here, other materials are also conceivable. In FIG. 20, the intention is to show that the combination of first layer 1 and second layer 2 or the further layers can also be located merely in the ring.

The invention claimed is:

1. A device selected from the group consisting of coins, medals and casino tokens, the device consisting essentially of:

a first side;

a second side;

one first layer made of a first material and having a thickness of 10 μm to 90 μm, said first layer forming at least certain portions of said first side; and at least one second layer made of a second material, said second layer forming at least certain portions of said second side, said first and second materials being different materials, said second material being selected from the group consisting of copper, copper alloy, CuNi25 and CuZn20Ni5.

2. The device according to claim 1, wherein said second layer has a thickness of 0.8 mm to 2.8 mm.

3. The device according to claim 2, wherein said second layer has a thickness of 1.8 mm.

4. The device according to claim 1, further comprising a third layer made of a third material disposed on a side opposite to said first layer.

5. The device according to claim 4, wherein said first material, said third material or both said first and third materials is selected from the group consisting of copper, a copper alloy, CuNi8, CuNi10, CuZn6723 and CuZn20Ni5.

6. The device according to claim 4, wherein said first material and said second material and also said first material and said third material are different materials.

7. The device according to claim 1, wherein said first material, said second material or both said first and second materials have an electrical conductivity of 4 to 106% IACS.

8. The device according to claim 1, wherein said thickness of said first layer is 20 μm.

9. The device according to claim 1, wherein said first material, said second material or both said first and second materials have an electrical conductivity of 4 to 30% IACS.

10. A device selected from the group consisting of coins, medals and casino tokens, the device consisting essentially of:

a first side;

a second side;

one first layer made of a first material and having a thickness of 10 μm to 90 μm;

at least one second layer made of a second material, said first and second materials being different materials;

a further second layer made of said second material;

a main body, said second layer and said first layer are disposed on one side of said main body and said further second layer is disposed on an opposite side of said main body; and said first layer forming at least certain portions of said first side and said further second layer forming at least certain portions of said second side.

11. The device according to claim 10, wherein said second layer and said further second layer have a thickness of 50 μm to 600 μm.

12. The device according to claim 10, further comprising:

a ring; and a core disposed inside said ring, wherein said core, said ring or both said core and said ring have said first layer, said second layer, said further second layer and said main body.

13. The device according to claim 12, wherein said first layer of said core is disposed on a side opposite to said first layer of said ring.

14. The device according to claim 10, wherein said second layer and said further second layer are formed of a same material.

15. The device according to claim 10, wherein said second layer and said further second layer have a thickness of 300 μm to 400 μm.

16. The device according to claim 10, further comprising a third layer made of a third material disposed on a side opposite to said first layer.

17. The device according to claim 10, wherein said second material is selected from the group consisting of copper, copper alloy, CuNi25 and CuZn20Ni5.

18. A method for producing a device selected from the group consisting of coins, medals and casino tokens, which comprises the step of:

producing the device from a clad sheet-shaped composite material, the clad sheet-shaped composite material consisting essentially of: a first side, a second side, one first layer made of a first material and having a thickness of 10 μm to 90 μm and at least one second layer made of a second material, the first layer forming at least certain portions of the first side and the second layer forming at least certain portions of the second side, the first material and the second material being different materials, the second material being selected from the group consisting of copper, copper alloy, CuNi25 and CuZn20Ni5.

19. The method according to claim 18, which further comprises punching the clad sheet-shaped composition material for forming the device.

20. A method for producing a device selected from the group consisting of coins, medals and casino tokens, which comprises the steps of:

punching a core and a ring from a clad sheet-shaped composite material;

subsequently inserting the core turned into the ring; and fastening the core in the ring, the core, the ring or both the core and the ring consisting essentially of: a first side, a second side, a first layer made of a first material with a thickness of 10μm to 90μm, a second layer made of a second material, a further second layer made of the second material, the second layer and the first layer are disposed on one side of the core and the further second layer is disposed on an opposite side of the core, the first layer forming at least certain portions of the first side and the further second layer forming at least certain portions of the second side, the second layer and the further second layer have a thickness of 50 μm to 600 μm.

* * * * *